US010780482B2

(12) United States Patent
Chen et al.

(10) Patent No.: US 10,780,482 B2
(45) Date of Patent: Sep. 22, 2020

(54) TUBE-PROPELLING APPARATUS FOR TUBE BENDING MACHINE

(71) Applicant: ZHEJIANG MOTORBACS AUTOPARTS CO., LTD., Zhejiang (CN)

(72) Inventors: Chieh-Wei Chen, Ning Po (CN); Jun Lu, Ning Po (CN)

( * ) Notice: Subject to any disclaimer, the term of this patent is extended or adjusted under 35 U.S.C. 154(b) by 0 days.

(21) Appl. No.: 14/406,747

(22) PCT Filed: Mar. 30, 2013

(86) PCT No.: PCT/CN2013/000305

§ 371 (c)(1),
(2) Date: Dec. 10, 2014

(87) PCT Pub. No.: WO2013/181920

PCT Pub. Date: Dec. 12, 2013

(65) Prior Publication Data

US 2015/0158071 A1 Jun. 11, 2015

(30) Foreign Application Priority Data

Jun. 6, 2012 (CN) ..... 2012 1 0190236

(51) Int. Cl.
*B21D 9/05* (2006.01)
*B21D 43/00* (2006.01)

(52) U.S. Cl.
CPC ..... *B21D 9/05* (2013.01); *B21D 43/006* (2013.01)

(58) Field of Classification Search
CPC ..... B21D 7/024; B21D 7/025; B21D 7/16; B21D 9/00; B21D 9/04; B21D 9/05;
(Continued)

(56) References Cited

U.S. PATENT DOCUMENTS 5,379,624 A * 1/1995 Harman ..... B21D 9/073 72/149
2005/0016239 A1* 1/2005 Schmauder ..... B21D 9/07 72/150

FOREIGN PATENT DOCUMENTS

CN 202621661 U * 12/2012

OTHER PUBLICATIONS

Machine Translation of CN 202621661 provided by EPO website (Espacnet).*

(Continued)

*Primary Examiner* — Peter Dungba Vo
*Assistant Examiner* — Joshua D Anderson
(74) *Attorney, Agent, or Firm* — Alexander Chen, Esq.

(57) ABSTRACT

Disclosed is a tube-propelling apparatus for a tube bending machine. The apparatus comprises a main tube-propelling base mounted on a slide rail mechanism of a tube bending machine tool, wherein a penetrating hole though which both a fixing sleeve and a core rod pass is provided on the main tube-propelling base, the rear end of the fixing sleeve is fixed in the penetrating hole, and the front end of the fixing sleeve is provided with a tube clamping apparatus. The propelling apparatus further comprises a surplus material auxiliary propelling base mounted on the slide rail mechanism of the tube bending machine tool, wherein the surplus material auxiliary propelling base is provided with a through-hole coaxial with the penetrating hole of the main tube-propelling base. An auxiliary pushing sleeve is mounted in the through-hole, and the core rod passes through the auxiliary pushing sleeve. Meanwhile, the auxiliary pushing sleeve is sheathed in the fixing sleeve and the front end of the auxiliary pushing sleeve is provided with a propelling head engaging with a tube. The tube-propelling apparatus has a simple and rational structure, and can fully utilize surplus material.

11 Claims, 8 Drawing Sheets

(58) Field of Classification Search
CPC . B21D 9/07; B21D 9/16; B21D 11/22; B21D 43/00; B21D 43/003; B21D 43/006; B21D 43/012; B21D 43/026; B21D 43/027; B21D 43/10; B21D 43/13; B23Q 7/001; B23Q 7/042
USPC ..... 72/149, 150, 306, 307, 369, 381, 384, 72/391.2, 391.4, 391.6, 420, 449, 454, 72/455, 456; 414/14–20, 745.3, 746.3, 414/746.5, 746.8
See application file for complete search history.

(56) References Cited

OTHER PUBLICATIONS

Bibliographic information for CN 202621661 including inventor names and publication date provided from East.*

* cited by examiner

TUBE-PROPELLING APPARATUS FOR TUBE BENDING MACHINE

BACKGROUND OF INVENTION

1. Field of the Invention

The present invention relates to a tube bending push apparatus, in particular a tube bending apparatus can chuck more tube in a tube bending machine than conventional tube pushing apparatus.

2. Description of Related Art

Tube bending technology is widely used in many industries such central air conditioning industry, automotive industry, aerospace industry, shipbuilding industry and many other manufacturing industry. In manufacturing elbow (tube, tube and etc.), the quality of elbow will directly affect the structure integrity, safety and reliability of the final products of these industries. In the process of bending tube in the desirable form a bending machine feeder is use to control and feed tube into bending machine. However, when bending machine bends the tube in the final processing stage, the front push end of the feeder reaches the top of crease plate in the bending machine. In this case, due to crease plate restriction, the feeder cannot push the tube forward anymore, therefore, the remaining portion of the tube cannot be process and thus, the unprocessed portion is discarded from the tube and is treated as production waste.

Chinese patent application publication No. ZL201020151025 discloses a clamping device concealed in a tube bending machine, said clamping device comprises a push tube to be sleeved on a positioning tube of the bending machine, a drive device for pushing the push tube forward or backward in relation to the positioning tube, a push tube actuation tube clamp seat and a tube clamp seat actuation material clamp. When the push tube is pushed forward by the drive device, which at the same time actuates the tube clamp seat and material clamp to radially contract; and when the push tube moves back, which at the time actuates the tube clamp seat and the material clamp to radially expand, is this way to generate loosening or tightening force on a tube and reached to solve the problem of material waste.

Another similar tube bender patent application (Taiwan patent application no. 95113271) also proposed a solution to the problem of material waste. Similar to CN ZL201020151025, a base is sleeved on a one end of an outer tube, an inner tube is provided within the outer tube, the outer tube is further provided with two slots, the inner tube and the base is secured together with two locking devices that pass through the two slots on the outer tube, when the base is actuated, the inner tube is moved relatively to the outer tube, at the same time, a support seat provides support force to the tube support seat in order to secure a tube.

However, the above-mentioned tube bender inventions are structurally complex and difficult to assemble. Moreover, a core rod is inserted into the tube during bending process, in order to ensure the roundness of the bend section. The above-mention bender will interfere with the core rod such that the surplus material may not be pushed out totally from the tube clamp. If it one is to adapt to these bender and decreases the core rod radius, then it cannot guarantee the soundness of the bend section, and it may easily cause wrinkle in the bend section. Therefore, the above-mentioned benders may fully utility the tube material however, the quality of the finishing tube is compromised.

SUMMARY OF INVENTION

In order to solve the above-mentioned problems the present invention provides a bending machine that is simple in structure and assure the bending quality of the tube at the time fully utilize surplus material during the process.

To achieve the above-mention objectives, the present invention provides a bending machine comprises: a main tube-propelling base mounted on a slide rail mechanism that can be slide forward and backward; the main tube-propelling base is further provided with a penetrating hole though which both a fixing sleeve and a core rod pass are secured on the main tube-propelling base, which the rear end of the fixing sleeve is fixed in the penetrating hole, and the front end of the fixing sleeve is provided with a tube clamping apparatus.

It is characterized that present invention further comprises: a surplus material auxiliary propelling base mounted on the slide rail mechanism of the tube bending machine tool, wherein the surplus material auxiliary propelling base is provided with a through hole coaxial with the penetrating hole of the main tube-propelling base, an auxiliary pushing sleeve is mounted in the through-hole, and the core rod passes through the auxiliary pushing sleeve. Meanwhile, the auxiliary pushing sleeve is sheathed in the fixing sleeve and the front end of the auxiliary pushing sleeve is provided with a propelling head engaging with a tube; and a drive part for moving the surplus material auxiliary propelling base back and forth.

As a further improvement, the slide rail mechanism is provided with a tube locking controlling base that can slide back and forth, a passing-hole is provided on the tube locking controlling base and an axis sleeve is provided inside the passing-hole and between the fixing sleeve and auxiliary pushing sleeve, the front end of the axis sleeve is coupled with the tube clamping apparatus.

Advantageously, same one slide rail mechanism is used for the main tube-propelling base, surplus material auxiliary propelling base and tribe locking controlling base. To be used as a specific technical solutions, the tube clamping apparatus comprises a tube clamp mounted on the fixing sleeve, one end of tube clamp is arranged with elastic claws, while the front end is tapped and coupled with the axis sleeve.

As a further improvement, bending machine is provided with a rack next to the slide rail mechanism, the bottom of the main tube-propelling base is provided with a first gear powered by a first electric power motor; the first gear engages with the rack to enable a back and forth sliding movement.

Advantageously, the power pushing mechanism for the bending machine comprise a second electric power motor mounted on the main tube-propelling base, with a steel threaded rod. One end of the steel threaded rod is connected with a threaded nut on the surplus material auxiliary propelling base.

Advantageously, the power pushing mechanism comprises the second electric power motor mounted on the surplus material auxiliary propelling base, the surplus material auxiliary propelling base is mounted on the rack next to the slide rail mechanism, the bottom of the surplus material auxiliary propelling base is provided with a second gear for the second electric power motor, and the second gear engages with the rack to enable a back and forth sliding movement.

To be used as a specific technical solutions, the tube locking controlling base is provided with a nut, correspondingly, the main tube-propelling base is provided with a third electric power motor, the output end of the third electric power motor is connected with one end of a driving threaded rod, and the other end of the threaded rod is connected with the nut on the tube locking controlling base.

As an improvement, the propelling head is disposed on the tip of the auxiliary pushing sleeve and is removable.

Preferably, removable refers to the propelling head comprises a pinhead end and the front peripheral side end of the auxiliary pushing sleeve is provided with pin holes, the surface of the auxiliary pushing sleeve is also provided with a threaded hole and a screw with a ball tip is tapped into the threaded hole, a spring is provided in the cavity of the threaded hole to support the ball tip, the pinhead end is inserted into the pin holes and the ball tip pushes against the pinhead end inside the pin holes.

Preferably, removable refers to the front end of the propelling head pushes and fits with the tube, and the back end of the propelling head is a threaded connection joint to be fixed with the auxiliary pushing sleeve.

As a further improvement, the back end of the fixing sleeve is rotatably fixed inside the through hole to facilitate the rotation and other processing of the tube.

Compared with the prior art, the advantages of the present invention is: combining the main tube-propelling base and tube locking controlling base, and the surplus material auxiliary propelling base, through a quick adjustable propelling head according to the thickness of the tube wall, the surplus tube material from the conventional bender machine can be entirely pushed through the machine without the restriction from the core rod, as such, reducing waste and increasing output; and the simple construction of the device can be easily fitted onto the bender machine.

DETAILED DESCRIPTION OF THE INVENTION

Figure 1:
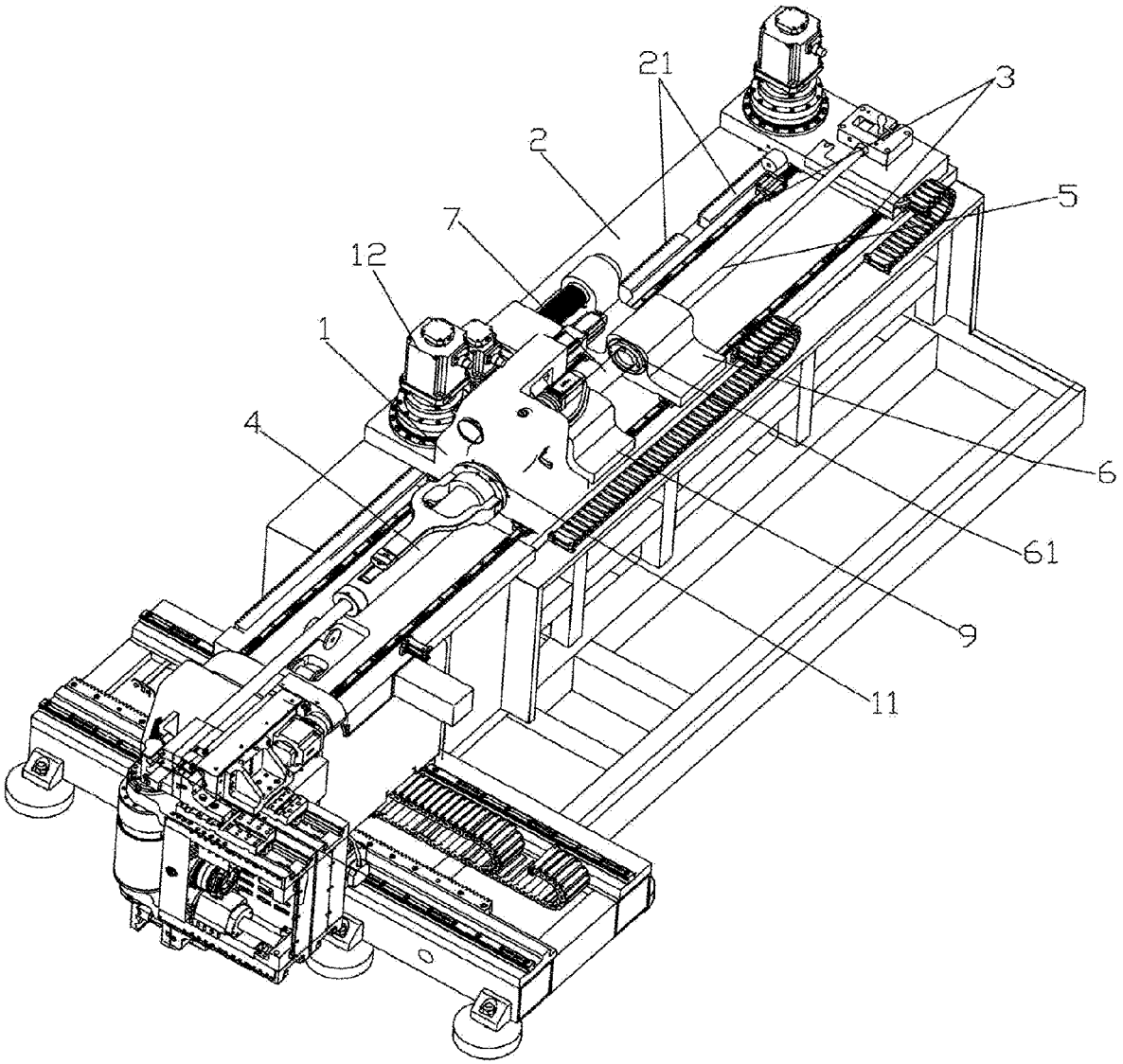
FIG. 1 is a structural view of the present invention bender machine.
Figure 2:
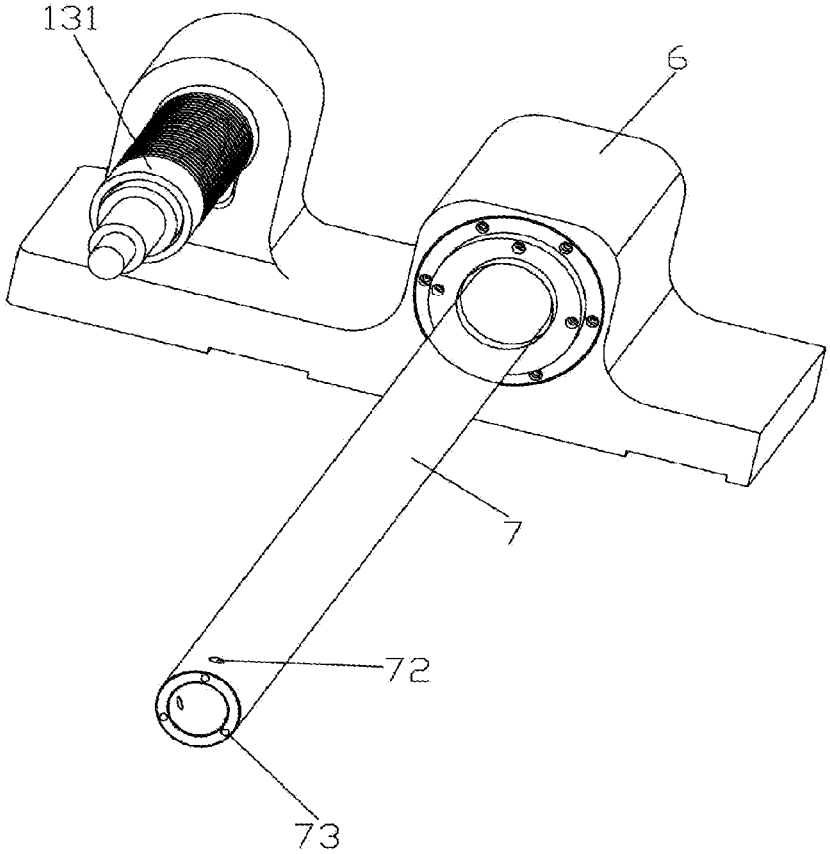
FIG. 2 is a structural view the surplus material auxiliary propelling base.
Figure 3:
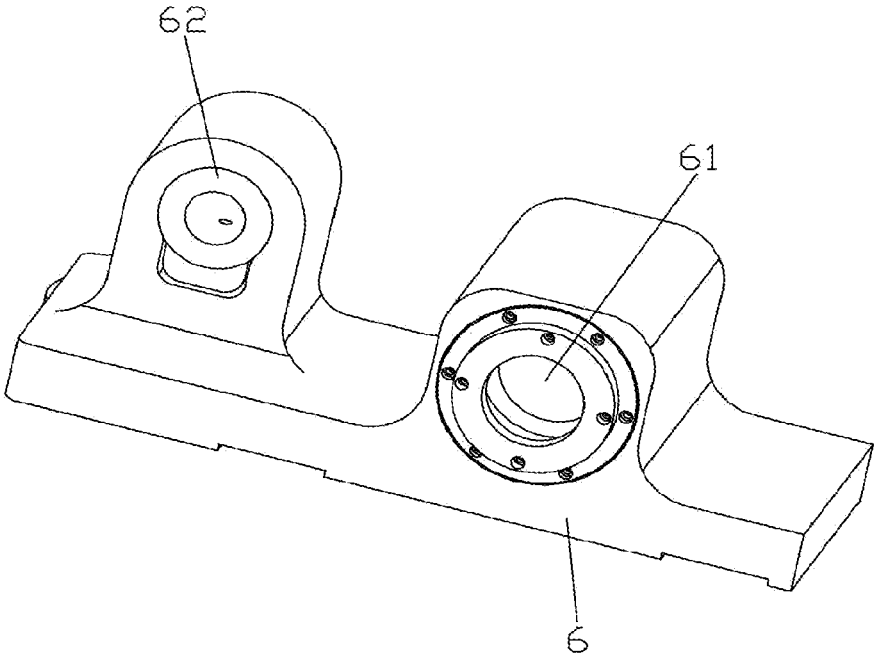
FIG. 3 is a structural view the surplus material auxiliary propelling base without the auxiliary pushing sleeve.
Figure 4:
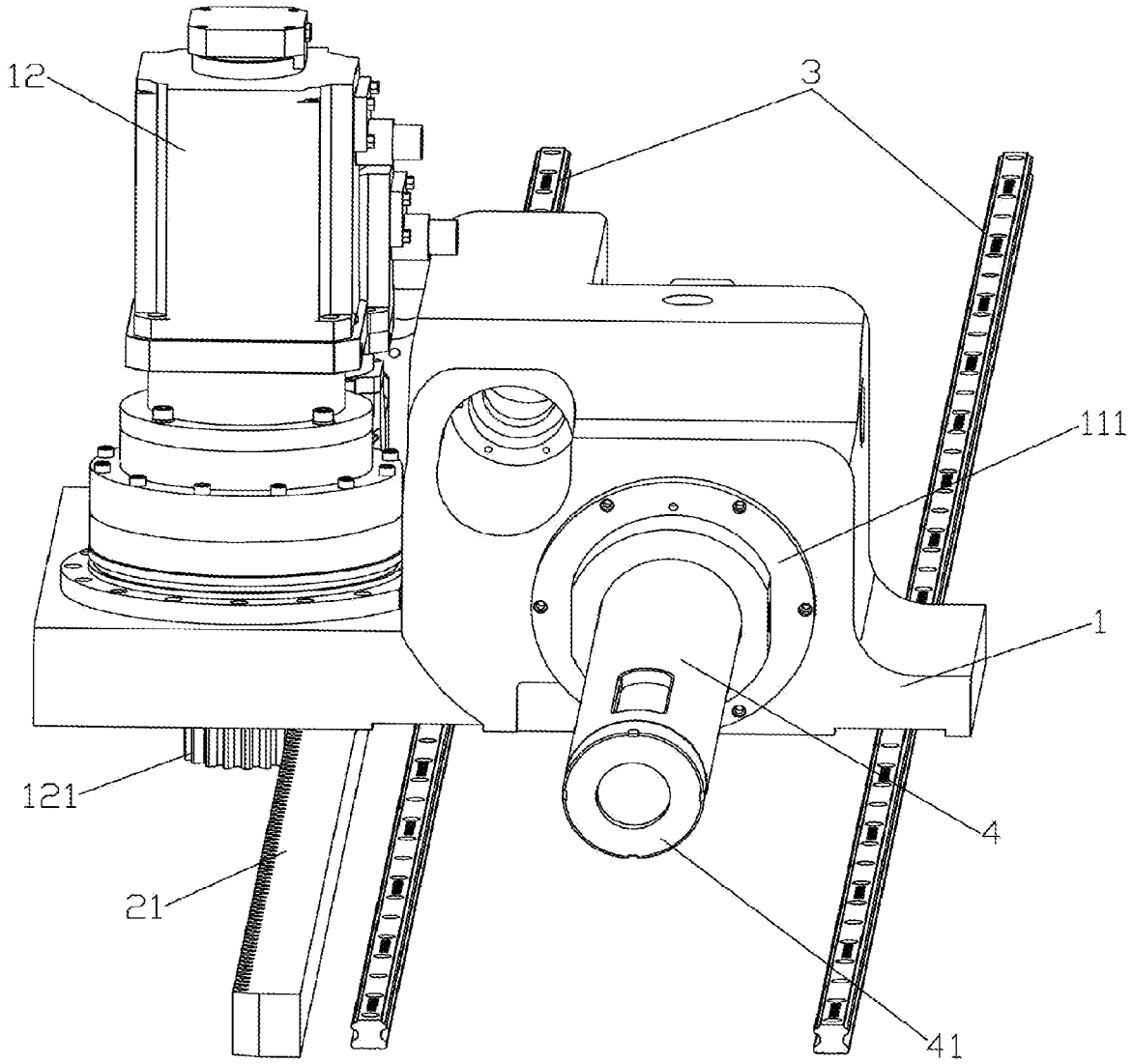
FIG. 4 is a perspective view of the main tube-propelling base.
Figure 5:
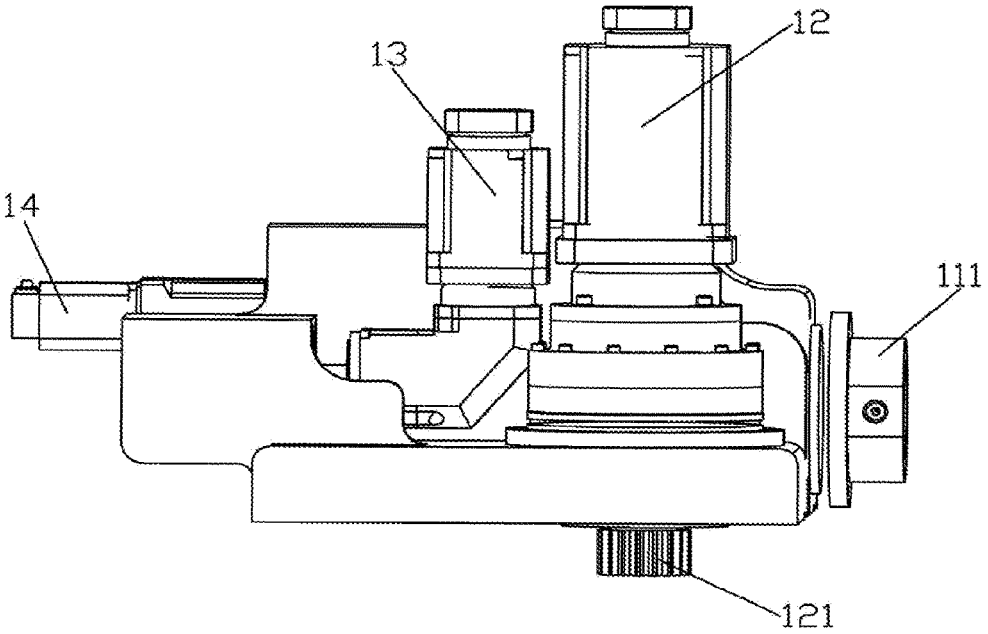
FIG. 5 is a side view of the main tube-propelling base.

The accompanying drawings of embodiments of the present invention will be further described in detail.

As shown in FIG. 1~FIG. 11, the present invention a tube-propelling apparatus for tube bending machine comprises a main tube-propelling base 1 mounted on the slide rail mechanism 3 of a bending machine 2, the main tube-propelling base 1 can be slide back and forth through a sliding block mounted on the bottom with the sliding rail mechanism 3; the main tube-propelling base is provided with a penetrating hole 11 for receiving a fixing sleeve 4 and a core rod 5, the back end of the fixing sleeve 4 is provided with a flange structure 111 for rotatably fixed in the penetrating hole 11, the front end of the fixing sleeve 4 is provided with a tube clamp apparatus 41 for securing the tube, and the core rod 5 passes through the penetrating hole 11 but not touching the penetrating hole 11, as shown in the figures.

As a preferred embodiment; the sliding rail mechanism 3 of the bending machine 2 is provided with a rack 21, the main tube-propelling base 1 is mounted on the rack 21, furthermore, the bottom of the main tube-propelling base 1 is provided with a first electric motor 12 for powering a first gear 121, the first gear 121 engages with the rack 21 for allowing sliding movement of the main tube-propelling base 1; of course other means of sliding structure can be used for sliding the main tube-propelling base on the slide rail mechanism 3, such as with electric motor and threaded rod and nut, as shown in the figures.

The present invention is further provided with a surplus material auxiliary propelling base 6, for the purpose of saving production costs; said surplus material auxiliary propelling base 6 is also mounted on the sliding rail mechanism 3 of the bending machine 2 and can slide back and forth on the sliding rail mechanism 3 through a sliding block.

Figure 8:
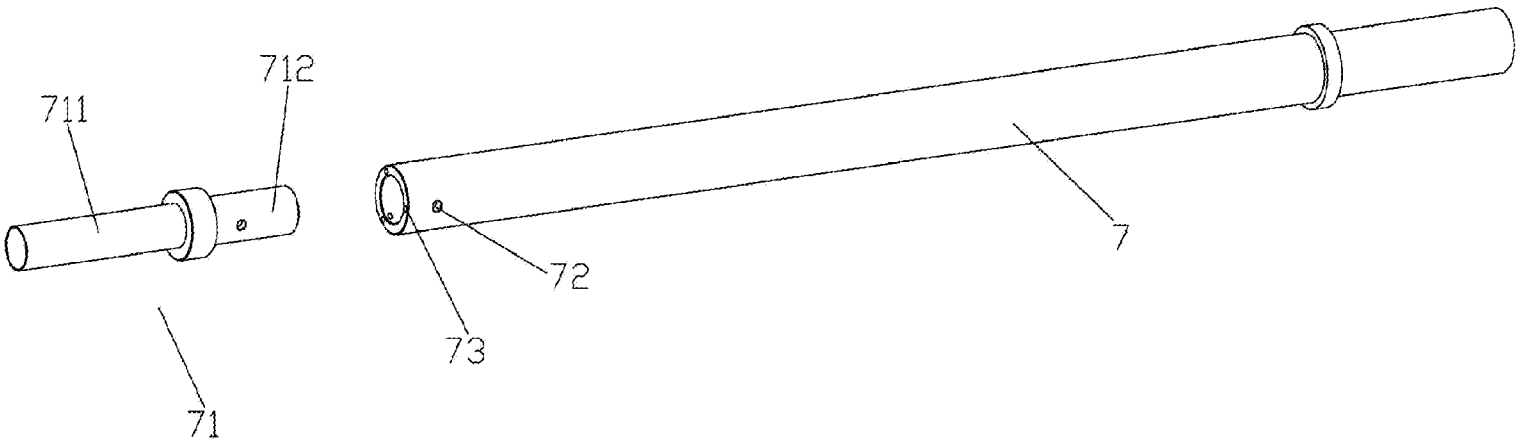
FIG. 8 is a structural view of the propelling head.

The surplus material auxiliary propelling base 6 is provided with a through hole 61 that has the same axis with the penetrating hole 11 of the main tube-propelling base 1, an auxiliary pushing sleeve 7 is provided in the through hole 61 for the core rod 5 to pass through the auxiliary pushing sleeve 7, at the same time, the auxiliary pushing sleeve 7 is sleeved by the fixing sleeve 4, the front end of the auxiliary pushing sleeve 7 is provided with a pushing head 71, as shown in FIG. 8.

Figure 9:
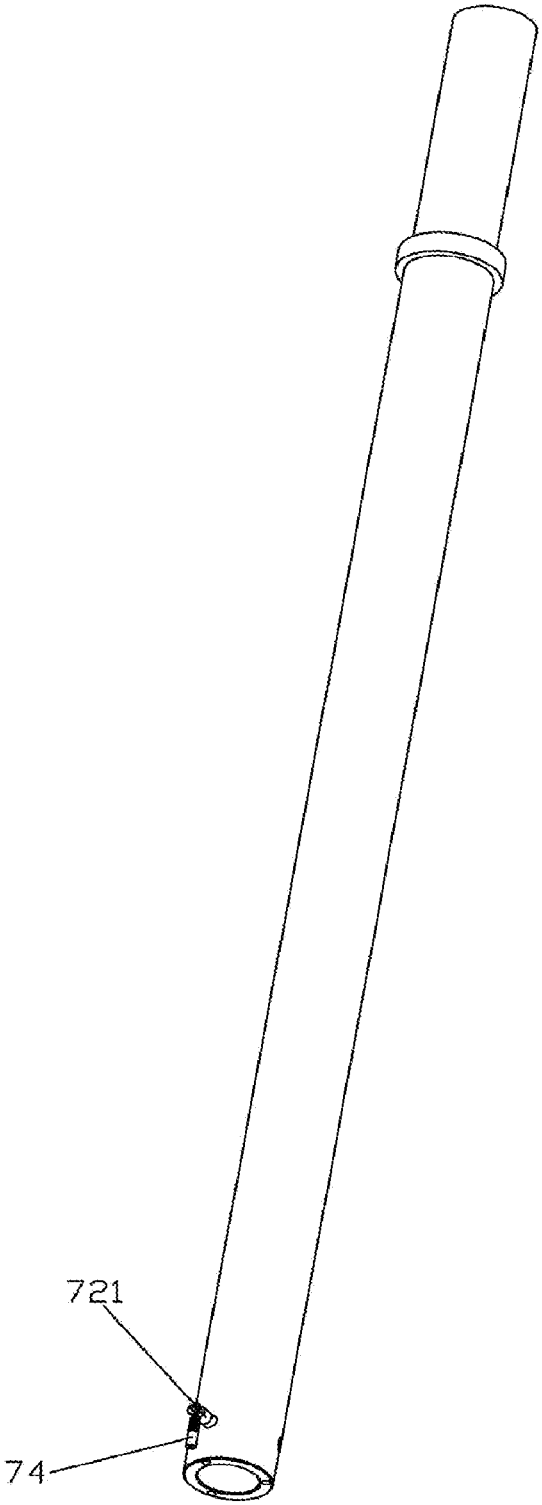
FIG. 9 is an installation view of the propelling head.
Figure 10:
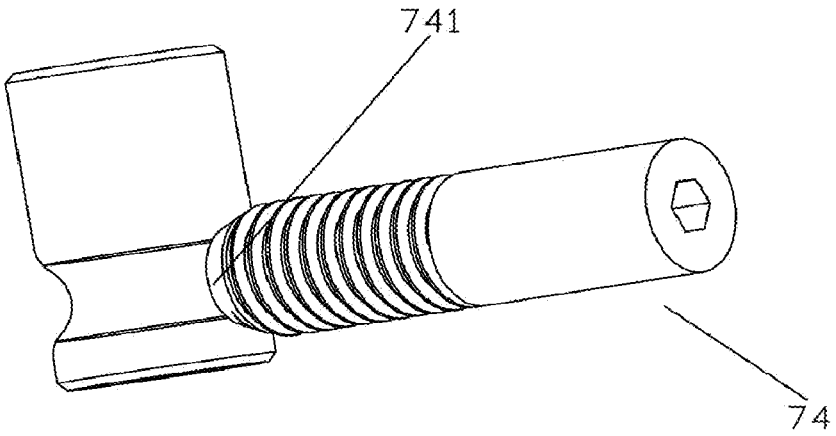
FIG. 10 is a structural view of the pin and screw.

Pushing head 71 can be removably attached to the front end of the auxiliary pushing sleeve 7, as a preferred embodiment, the front end of the pushing head 71 is provided with a plug and push part 711 and the back end of the pushing head 71 is a receive and connect part 712, in addition, the front end of the auxiliary sleeve 7 is provided with a pin hole 72 and the front peripheral end of the auxiliary sleeve 7 is provided with threaded holes 73, a screw nail 74 with a ball point 741 is tightened in the threaded hole 73, a spring is provided to support the ball point 741 in cavity of the screw nail 74, the spring maintains the ball point in a protruding position, a pin 721 is inserted into the pin hole 72 and pushes against the receive and connect part 712 of the pushing head 71, the ball point 741 of the screw nail 74 pushes against a limiting groove on the pin 721, as shown in FIGS. 8, 9, and 10, of course, the pushing head 71 can adopt a simple thread joint to be attached to the front end of the auxiliary pushing sleeve 7.

Figure 6:
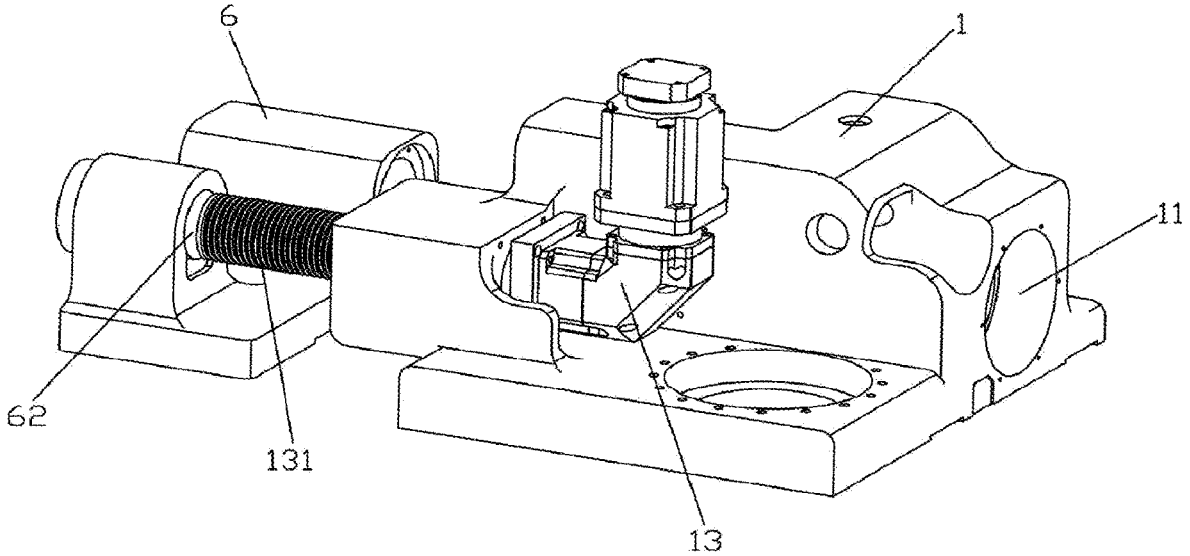
FIG. 6 is a perspective view of a power motor.

The surplus material auxiliary propelling base 6 is further provided with a power pushing apparatus for sliding the surplus material auxiliary propelling base 6 back and forth. Said power pushing apparatus may slide the surplus material auxiliary propelling base 6 in various way, as a preferred embodiment, the power pushing apparatus in the present invention comprises a second electric motor 13 mounted on the main tube-propelling base 1 and a threaded rod 131 matching with the second electric motor 13; one end of the threaded rod 131 connects with a thread nut 62 on the surplus material auxiliary propelling base 6, as shown in FIG. 6. Of course, the surplus material auxiliary propelling base 6 can also slide back and forth on the sliding rail mechanism 3 with a rack, a gear and an electric motor set up.

The sliding rail mechanism 3 of the bending machine 2 is further provided with a tube locking controlling base 9 that can slide back and forth, the tube locking controlling base 9 is provided with a through hole 91; a shaft sleeve 10 is provided inside the through hole 91. The shaft sleeve 10 sets between the fixing sleeve 4 and auxiliary pushing sleeve 7, the front end of the shaft sleeve 10 couples with the tube clamp apparatus 41, as shown in FIG. 7.

Figure 7:
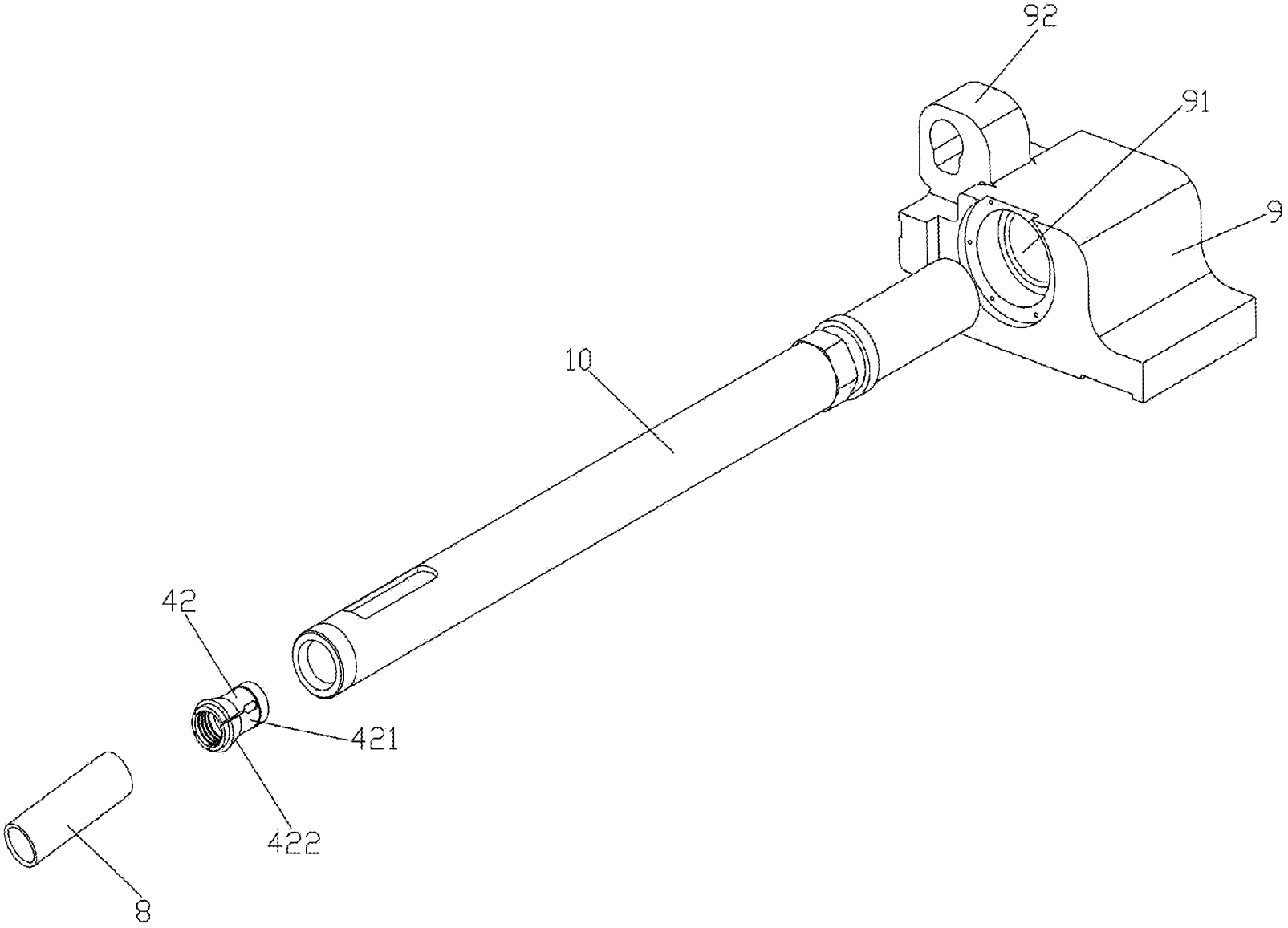
FIG. 7 is a structural view of the tube clamp and auxiliary pushing, sleeve.

As a preferred embodiment for coupling with the shaft sleeve 10, the tube clamp apparatus 41 in the present invention comprises a tube clamp 42 fixed on the fixing sleeve 4, one end of the tube clamp 42 is slotted to form an elastic tube claw 421 and the other end of the tube clamp 42 is provided with a tapered surface 422 to be coupled with the front end of the shaft sleeve 10, as shown in FIG. 7. Of course, the tube clamp apparatus 41 can also be used the hand operated claw commonly seen, but the effect would not be optimal.

Figure 11:
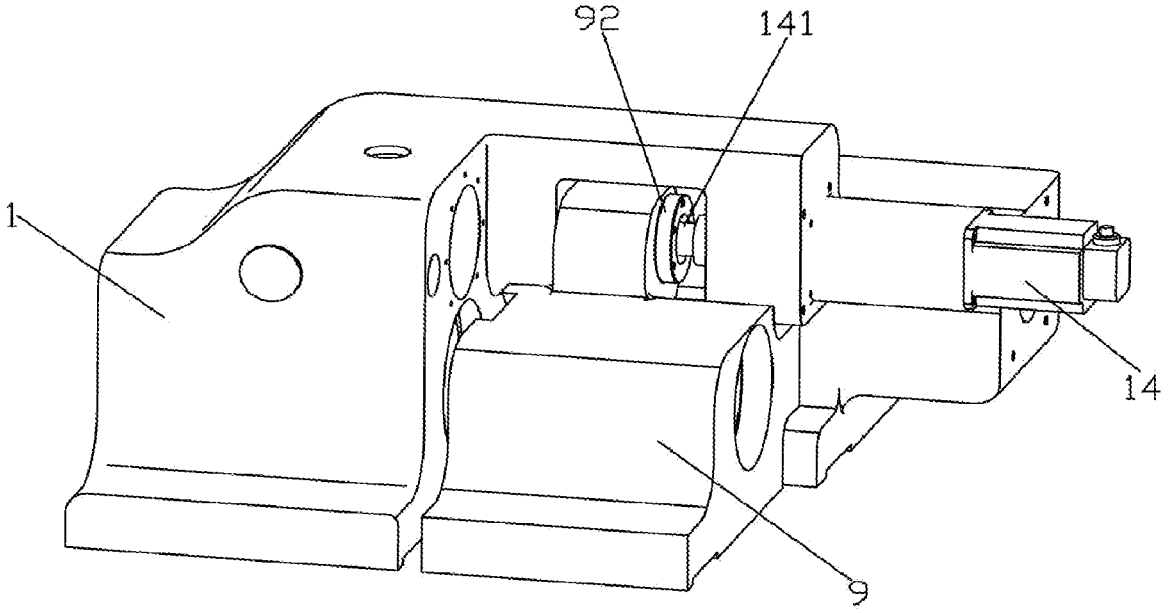
FIG. 11 is a connection view of the tube locking controlling base and the main tube propelling base.

In order to allow the tube locking controlling base 9 to slide on the sliding rail mechanism 3, as a preferred embodiment, the tube locking controlling base 9 is provided with a nut 92, correspondingly, the main tube-propelling base 1 is provided with a third electric motor 14, the output end of the third electric motor 14 is provided with a threaded driving rod 141, one end of the threaded driving rod 141 connects with the nut 92 on the tube locking controlling base 92, as shown in FIG. 11.

In the present invention, when the main tube-propelling base 1 pushes the tube 8 into the end of the final bending process, the anti-wrinkle board in the bending machine 2 prevents the fixing sleeve 4 on the main tube-propelling base from pushing forward anymore, however, there is still an unprocessed portion of tube 8 left in the tube clamp apparatus 41, typically, this portion of tube 8 would be the waste material. In order to fully utilize the material, a control device triggers the second electric motor 13 and the surplus material auxiliary propelling base 6 slides forward, and the pushing head 71 pushes the back end of the tube 8, at the same time, the third electric motor 14 is triggered, and the tube locking controlling base 9 slides forward, the tube clamp apparatus 41 and tube clamp 42 work together release tube 8, and then, the surplus material auxiliary propelling base 6 slides forward more so that pushing head 71 pushes forward more such that, tube 8 is pushed through the tube clamp apparatus 41. The present invention provides that through the work of main tube-propelling base 1, with the operation of surplus material auxiliary propelling base 6 and tube locking controlling base 9, to allow full utilization of tube 8, while the whole apparatus is simple in structure can be easily integrated into an automated production process.

The invention claimed is:

1. A tube-propelling apparatus for tube bending machine comprising:

a main tube-propelling base 1 mounted on a slide rail mechanism 3 of a bending machine 2, the main tube-propelling base 1 can be slid back and forth through a sliding block mounted on the bottom of said main tube-propelling base; the main tube-propelling base is provided with a penetrating hole for receiving a fixing sleeve and a core rod, a back end of the fixing sleeve is fixed in the penetrating hole, the front end of the fixing sleeve is provided with a tube clamp apparatus for securing the tube; it is characterized by that: a surplus material auxiliary propelling base is provided and mounted on the slide rail mechanism that can slide back and forth; said surplus material auxiliary propelling base is provided with a through hole that has the same axis with the penetrating hole of the main tube-propelling base; an auxiliary pushing sleeve is provided in the through hole for the core rod to pass through the auxiliary pushing sleeve, at the same time, the auxiliary pushing sleeve is coaxial with the fixing sleeve; the front end of the auxiliary pushing sleeve is provided with a pushing head; and a power push apparatus for sliding the surplus material auxiliary propelling base back and forth, wherein said sliding rail mechanism of the bending machine is further provided with a tube locking controlling base that can slide back and forth, the tube locking controlling base is provided with a through hole; a shaft sleeve is provided inside the through hole of the tube locking controlling base, the shaft sleeve located between the fixing sleeve and auxiliary pushing sleeve, the front end of the shaft sleeve couples with the tube clamp apparatus.

2. The tube-propelling apparatus for tube bending machine as claimed in claim 1, wherein it is characterized that said slide rail mechanism is used at the same time for main tube-propelling base, surplus material auxiliary propelling base and the tube locking controlling base.

3. The tube-propelling apparatus for tube bending machine as claimed in claim 1, wherein said tube clamp apparatus 41 comprises a tube clamp 42 fixed on the fixing sleeve 4, one end of the tube clamp 42 is slotted to form an elastic tube claw 421 and the other end of the tube clamp 42 is provided with a tapered surface 422 to be coupled with the front end of the shaft sleeve 10.

4. The tube-propelling apparatus for tube bending machine as claimed in claim 1, wherein it is characterized that, a rack is provided by the side of slide rail mechanism; said main tube-propelling base is mounted on the said rack, and the bottom of the main tube-propelling base is provided with a first electric motor and a first gear; and said first gear engages with the said rack to allow a back and forth slide.

5. The tube-propelling apparatus for tube bending machine as claimed in claim 1, wherein it is characterized that the power pushing apparatus comprises a second electric motor mounted on the main tube-propelling base and a threaded rod of which one end of said threaded rod is connected to and powered by the second electric motor; and the other end of said threaded rod is connected to a threaded nut mounted on the surplus material auxiliary propelling base.

6. The tube-propelling apparatus for tube bending machine as claimed in claim 1, wherein it is characterized that the power pushing apparatus comprises a second electric motor mounted on the surplus material auxiliary propelling base; said surplus material auxiliary propelling base is also mounted on a rack by the slide rail mechanism; the bottom of the surplus material auxiliary propelling base is provided with a second gear powered by said second electric motor and the second gear engages with the rack to allow a back and forth slide.

7. The tube-propelling apparatus for tube bending machine as claimed in claim 1, wherein it is characterized that a threaded nut is provided and mounted on the tube locking controlling base, and correspondingly, a third electric motor is provided and mounted on the main tube-propelling base; one end of a threaded rod is connected to the output end of said third electric motor, and the other end of the threaded rod is connected to the threaded nut on the tube locking controlling base.

8. The tube-propelling apparatus for tube bending machine as claimed in claim 1, wherein it is characterized that said pushing head is removably attached to the front end of the auxiliary pushing sleeve.

9. The tube-propelling apparatus for tube bending machine as claimed in claim 8, wherein it is characterized that the front end of the pushing head is removably attached to the tube by a plug and connect part; and the back end of the pushing head is provided with a receive and connect part, and the front end of the auxiliary pushing sleeve is provided with a pin hole, and the front peripheral end of the auxiliary sleeve 7 is provided with threaded holes, a screw nail with a ball point is provided and tightened in the threaded hole, a spring is provided to support the ball point in a cavity of the screw nail, the spring maintains the ball point in a protruding position, a pin is inserted into the pin hole and pushes against the plug and connect part of the pushing head, the ball point of the screw nail pushes against a limiting groove provided on the pin.

10. The tube-propelling apparatus for tube bending machine as claimed in claim 8, wherein it is characterized that the front end of the pushing head is removably attached to the tube by a plug and connect part and the back end of the pushing head is a threaded connection part; the pushing head is attached to the auxiliary pushing sleeve through the threaded connection part.

11. The tube-propelling apparatus for tube bending machine as claimed in claim 1, wherein it is characterized that the back end of said fixing sleeve is rotatably mounted in the through hole.

* * * * *